US007431185B2

(12) United States Patent
Moeller et al.

(10) Patent No.: US 7,431,185 B2
(45) Date of Patent: Oct. 7, 2008

(54) FAN CONTROL FOR COMBUSTION-POWERED FASTENER-DRIVING TOOL BASED ON FIRING RATE

(75) Inventors: Larry M. Moeller, Mundelein, IL (US); Joseph E. Fabin, Elmwood Park, IL (US); James E. Doherty, Mount Prospect, IL (US); Kui-Chiu Kwok, Gurnee, IL (US); Yury Shkolnikov, Glenview, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 11/787,339

(22) Filed: Apr. 16, 2007

(65) Prior Publication Data

US 2007/0215664 A1 Sep. 20, 2007

Related U.S. Application Data

(62) Division of application No. 11/028,020, filed on Jan. 3, 2005.

(60) Provisional application No. 60/543,053, filed on Feb. 9, 2004.

(51) Int. Cl.
*B25C 1/14* (2006.01)

(52) U.S. Cl. ..... 227/10; 227/8; 227/130; 123/46 SC

(58) Field of Classification Search ..... 227/8, 227/10, 130; 123/46 SC
See application file for complete search history.

(56) References Cited

U.S. PATENT DOCUMENTS

| | | | |
|---|---|---|---|
| RE32,452 | E | 7/1987 | Nikolich |
| 5,133,329 | A | 7/1992 | Rodseth et al. |
| 5,592,580 | A | 1/1997 | Doherty et al. |
| 5,713,313 | A | 2/1998 | Berry |
| 5,911,350 | A | 6/1999 | Bolger et al. |
| 6,053,132 | A | 4/2000 | Evans |
| 6,123,241 | A | 9/2000 | Walter et al. |
| 6,722,550 | B1 | 4/2004 | Ricordi et al. |
| 6,783,045 | B2 | 8/2004 | Shima et al. |
| 6,796,476 | B2 | 9/2004 | Birk et al. |
| 6,983,871 | B2 | 1/2006 | Shima et al. |
| 7,040,261 | B2 | 5/2006 | Granacher et al. |
| 7,063,052 | B2 | 6/2006 | Nishikawa et al. |
| 2004/0182336 | A1 | 9/2004 | Ohmori et al. |
| 2005/0173487 | A1 | 8/2005 | Moeller et al. |
| 2006/0102111 | A1 | 5/2006 | Ohmori et al. |

*Primary Examiner*—Rinaldi I. Rada
*Assistant Examiner*—Michelle Lopez
(74) *Attorney, Agent, or Firm*—Greer, Burns & Crain, Ltd.; Lisa M. Soltis; Mark W. Croll

(57) ABSTRACT

A combustion-powered fastener-driving tool includes a combustion-powered power source; at least one fan associated with the power source during operation; and a control system operationally associated with the power source and connected to the at least one fan for adjusting the length of time for energizing the at least one fan as a function of the number of combustion firings by the power source.

3 Claims, 7 Drawing Sheets

FAN CONTROL FOR COMBUSTION-POWERED FASTENER-DRIVING TOOL BASED ON FIRING RATE

RELATED APPLICATION

This is a divisional of application Ser. No. 11/028,020, filed Jan. 3, 2005, and Applicants claim priority under 35 USC § 120 from the above-identified parent application, and from U.S. Ser. No. 60/543,053 filed Feb. 9, 2004.

BACKGROUND

The present invention relates generally to fastener-driving tools used for driving fasteners into workpieces, and specifically to combustion-powered fastener-driving tools, also referred to as combustion tools.

Combustion-powered tools are known in the art for use in driving fasteners into workpieces, and examples are described in commonly assigned patents to Nikolich U.S. Pat. Re. No. 32,452, and U.S. Pat. Nos. 4,522,162; 4,483,473; 4,483,474; 4,403,722; 5,197,646; 5,263,439 and 5,713,313, all of which are incorporated by reference herein. Similar combustion-powered nail and staple driving tools are available commercially from ITW-Paslode of Vernon Hills, Ill. under the IMPULSE® and PASLODE® brands.

Such tools incorporate a generally pistol-shaped tool housing enclosing a small internal combustion engine. The engine is powered by a canister of pressurized fuel gas, also called a fuel cell. A battery-powered electronic power distribution unit produces a spark for ignition, and a fan located in a combustion chamber provides for both an efficient combustion within the chamber, while facilitating processes ancillary to the combustion operation of the device. Such ancillary processes include: inserting the fuel into the combustion chamber; mixing the fuel and air within the chamber; and removing, or scavenging, combustion by-products. The engine includes a reciprocating piston with an elongated, rigid driver blade disposed within a single cylinder body.

A valve sleeve is axially reciprocable about the cylinder and, through a linkage, moves to close the combustion chamber when a work contact element at the end of the linkage is pressed against a workpiece. This pressing action also triggers a fuel-metering valve to introduce a specified volume of fuel into the closed combustion chamber.

Upon the pulling of a trigger switch, which causes the spark to ignite a charge of gas in the combustion chamber of the engine, the combined piston and driver blade is forced downward to impact a positioned fastener and drive it into the workpiece. The piston then returns to its original or pre-firing position, through differential gas pressures within the cylinder. Fasteners are fed magazine-style into the nosepiece, where they are held in a properly positioned orientation for receiving the impact of the driver blade.

The above-identified combustion tools incorporate a fan in the combustion chamber. This fan performs many functions, one of which is cooling. The fan performs cooling by drawing air though the tool between firing cycles. This fan is driven by power supplied by an onboard battery and, to prolong battery life, it is common practice to minimizing the run time of the motor. Also, short fan run time reduces fan motor wear (bearings and brushes), limits sound emitting from the tool due to air flow, and most importantly limits dirt infiltration into the tool. To manage fan 'on time', combustion tools typically incorporate a control program that limits fan 'on time' to 10 seconds or less.

Combustion tool applications that demand high cycle rates or require the tool to operate in elevated ambient temperatures often cause tool component temperatures to rise. This leads to a number of performance issues. The most common is an overheated condition that is evidenced by the tool firing but no fastener driven. This is often referred to as a "skip" or "blank fire." As previously discussed, the vacuum return function of a piston is dependent on the rate of cooling of the residual combustion gases. As component temperatures rise, the differential temperature between the combustion gas and the engine walls is reduced. This increases the duration for the piston return cycle to such an extent that the user can open the combustion chamber before the piston has returned, even with a lockout mechanism installed. The result is the driver blade remains in the nosepiece of the tool and prevents advancement of the fasteners. Consequently, a subsequent firing event of the tool does not drive a fastener.

Another disadvantage of high tool operating temperature is that there are heat-related stresses on tool components. Among other things, battery life is reduced, and internal lubricating oil has been found to have reduced lubricating capacity with extended high temperature tool operation.

Thus, there is a need for a combustion-powered fastener-driving tool which reduces fan on time. In addition, there is a need for a combustion-powered fastener-driving tool which manages tool operating temperatures within accepted limits to prolong performance and maintain relatively fast piston return to pre-firing position.

BRIEF SUMMARY

The above-listed needs are met or exceeded by the present combustion-powered fastener-driving tool which overcomes the limitations of the current technology. The present tool is provided with a temperature sensing system which more effectively controls running time of the fan. Fan run time may be determined by monitoring tool temperature, by comparing power source temperature against ambient temperature, or by controlling fan run time as a function of tool firing rate.

More specifically, a combustion-powered fastener-driving tool includes a combustion-powered power source, at least one fan associated with the power source, at least one temperature sensing device in operational proximity to the power source, and a control system operationally associated with the power source and connected to the at least one fan and the at least one temperature sensing device for adjusting the length of operational time of the at least one fan as a function of power source temperature sensed by the at least one temperature sensing device.

In another embodiment, a combustion-powered fastener-driving tool includes a combustion-powered power source, at least one fan associated with the power source during operation, and a control system operationally associated with the power source and connected to the at least one fan for adjusting the length of time of fan operation as a function of a rate of combustion firings by the power source.

DETAILED DESCRIPTION

Figure 1:
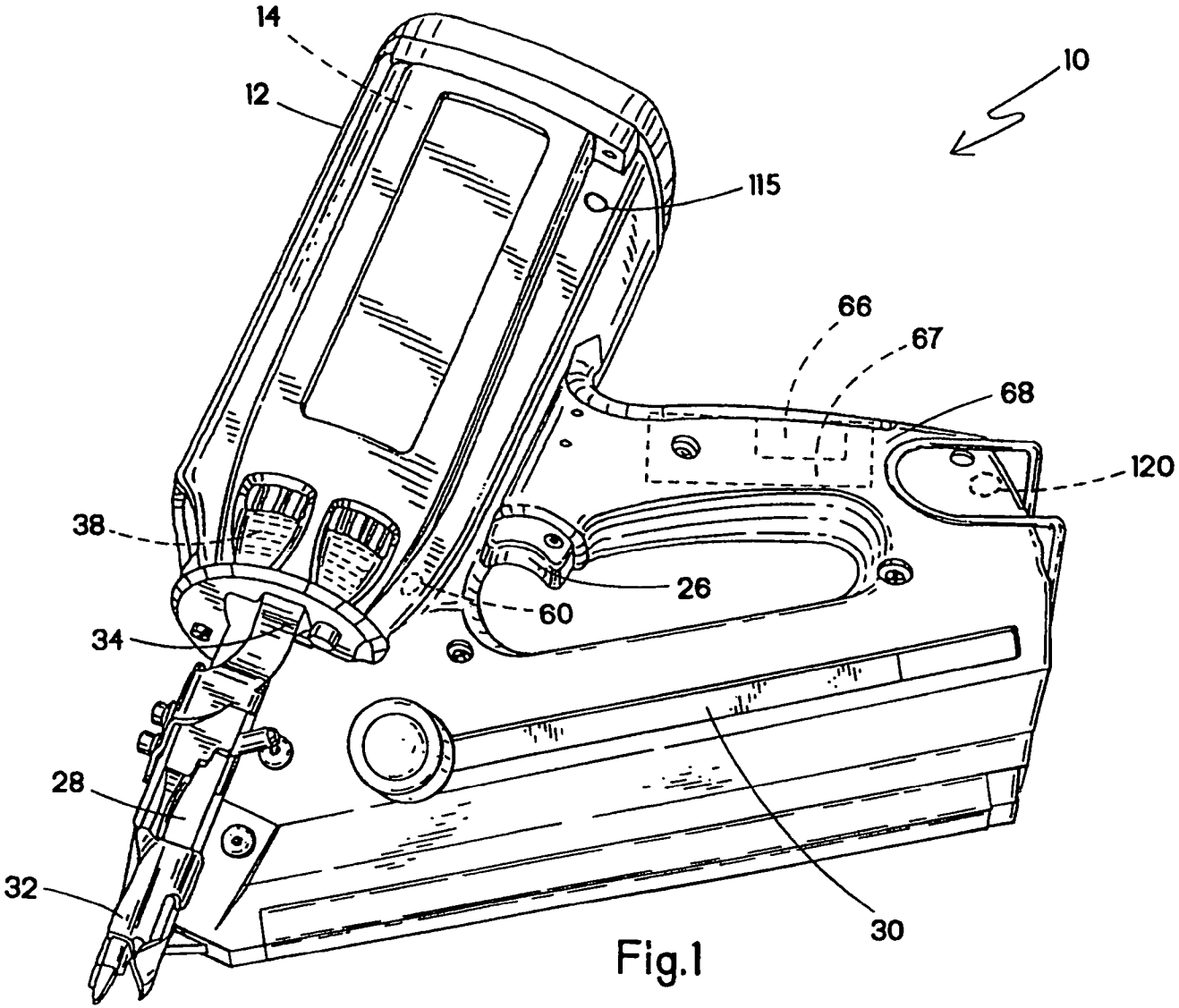
FIG. 1 is a front perspective view of a fastener-driving tool incorporating the present temperature control system.
Figure 2:
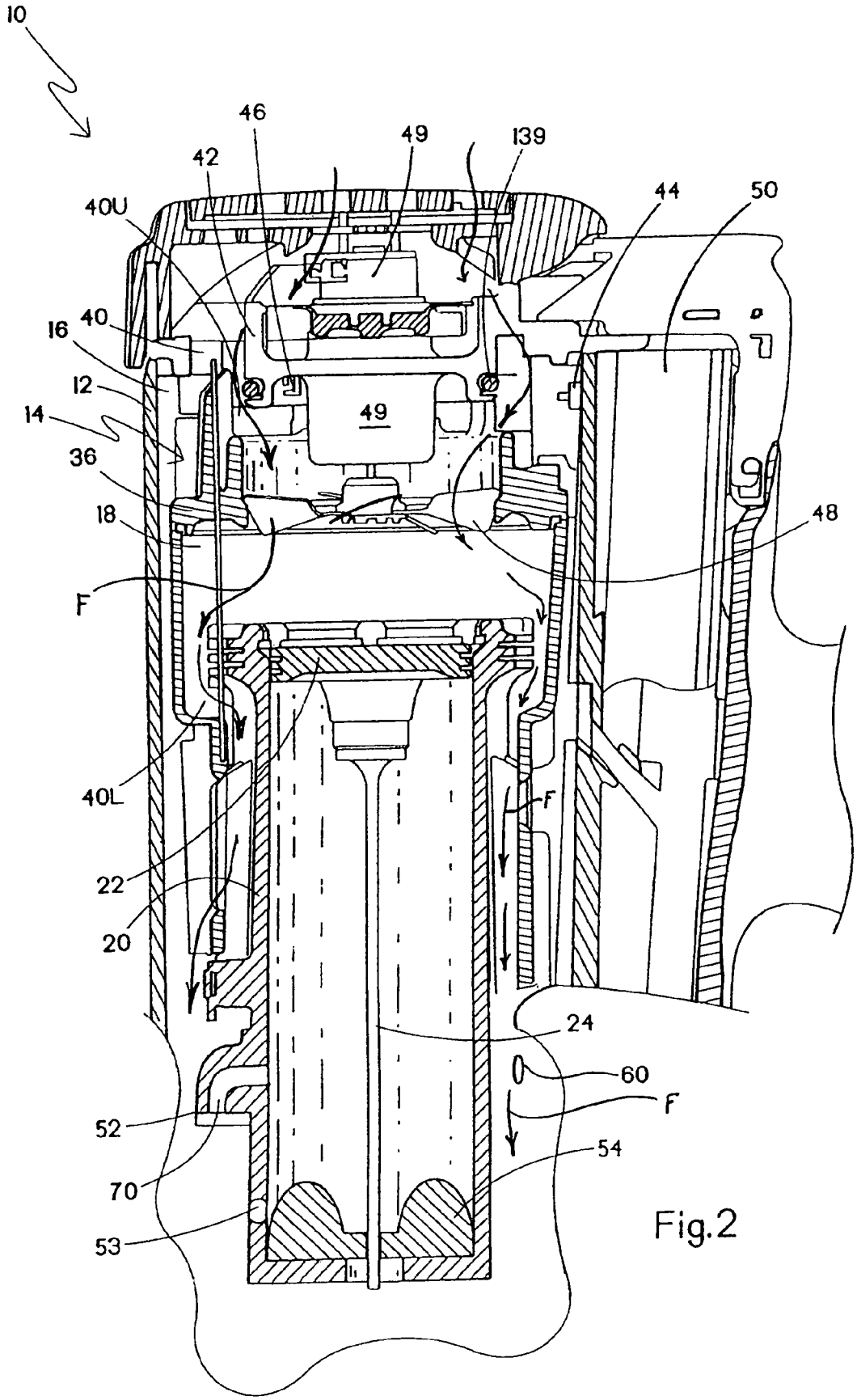
FIG. 2 is a fragmentary vertical cross-section of the tool of FIG. 1 shown in the rest position.
Figure 3:
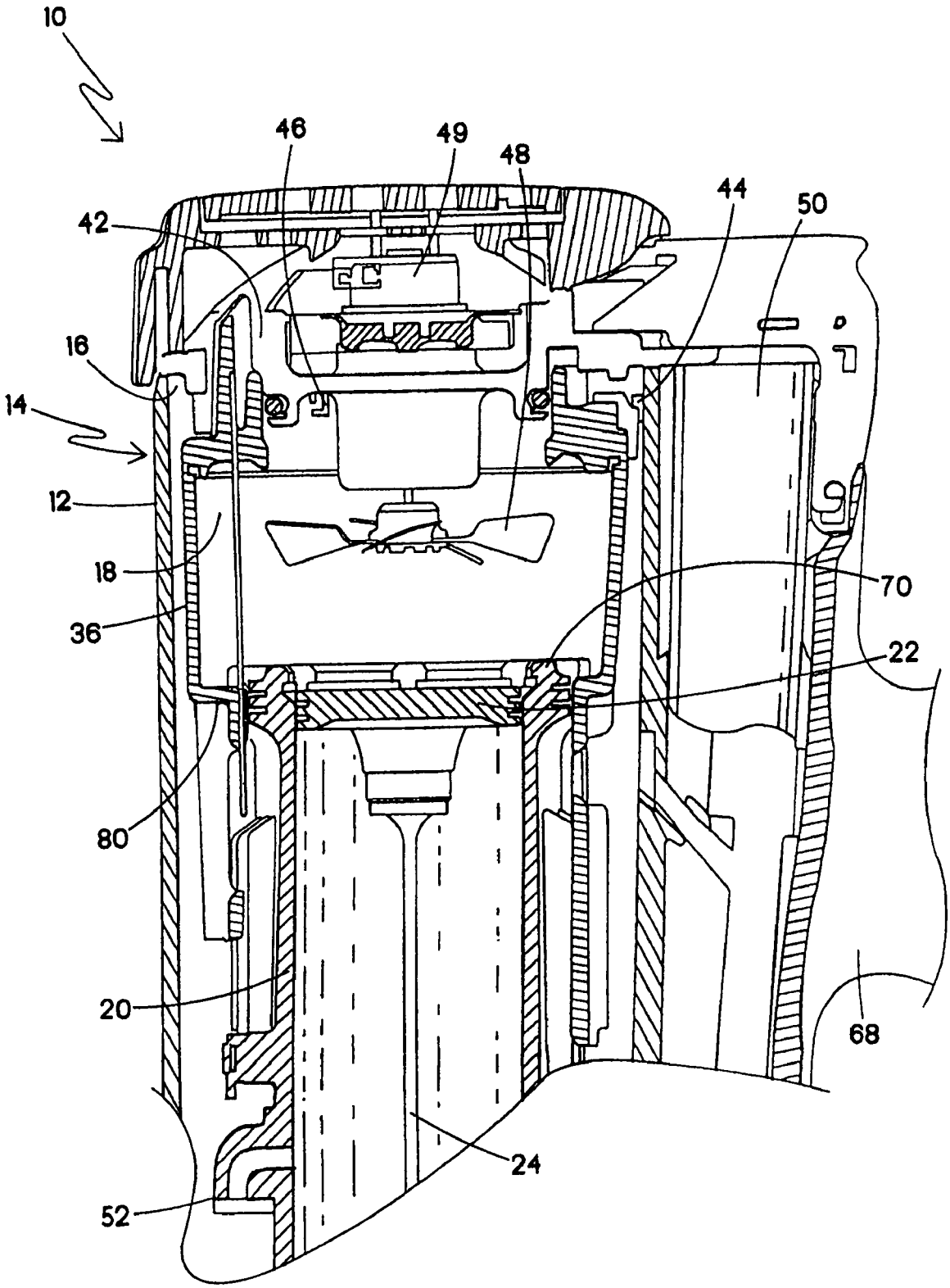
FIG. 3 is a fragmentary vertical cross-section of the tool of FIG. 2 shown in the pre-firing position.

Referring now to FIGS. 1-3, a combustion-powered fastener-driving tool incorporating the present control system is generally designated 10 and preferably is of the general type described in detail in the patents listed above and incorporated by reference in the present application. A housing 12 of the tool 10 encloses a self-contained internal power source 14 (FIG. 2) within a housing main chamber 16. As in conventional combustion tools, the power source 14 is powered by internal combustion and includes a combustion chamber 18 that communicates with a cylinder 20. A piston 22 reciprocally disposed within the cylinder 20 is connected to the upper end of a driver blade 24. As shown in FIG. 2, an upper limit of the reciprocal travel of the piston 22 is referred to as a top dead center or pre-firing position, which occurs just prior to firing, or the ignition of the combustion gases which initiates the downward driving of the driver blade 24 to impact a fastener (not shown) to drive it into a workpiece.

Through depression of a trigger 26 associated with a trigger switch 27 (shown hidden), an operator induces combustion within the combustion chamber 18, causing the driver blade 24 to be forcefully driven downward through a nosepiece 28 (FIG. 1). The nosepiece 28 guides the driver blade 24 to strike a fastener that had been delivered into the nosepiece via a fastener magazine 30.

Included in the nosepiece 28 is a workpiece contact element 32, which is connected, through a linkage 34 to a reciprocating valve sleeve 36, an upper end of which partially defines the combustion chamber 18. Depression of the tool housing 12 against the workpiece contact element 32 in a downward direction as seen in FIG. 1 (other operational orientations are contemplated as are known in the art), causes the workpiece contact element to move from a rest position to a pre-firing position. This movement overcomes the normally downward biased orientation of the workpiece contact element 32 caused by a spring 38 (shown hidden in FIG. 1). Other locations for the spring 38 are contemplated.

Through the linkage 34, the workpiece contact element 32 is connected to and reciprocally moves with, the valve sleeve 36. In the rest position (FIG. 2), the combustion chamber 18 is not sealed, since there is an annular gap 40 including an upper gap 40U separating the valve sleeve 36 and a cylinder head 42, which accommodates a chamber switch 44 and a spark plug 46, and a lower gap 40L separating the valve sleeve 36 and the cylinder 20. In the preferred embodiment of the present tool 10, the cylinder head 42 also is the mounting point for at least one cooling fan 48 and the associated fan motor 49 which extends into the combustion chamber 18 as is known in the art and described in the patents which have been incorporated by reference above. In addition, U.S. Pat. No. 5,713,313 also incorporated by reference, discloses the use of multiple cooling fans in a combustion-powered tool. In the rest position depicted in FIG. 2, the tool 10 is disabled from firing because the combustion chamber 18 is not sealed at the top with the cylinder head 42 and the chamber switch 44 is open.

Firing is enabled when an operator presses the workpiece contact element 32 against a workpiece. This action overcomes the biasing force of the spring 38, causes the valve sleeve 36 to move upward relative to the housing 12, closing the gap 40, sealing the combustion chamber 18 and activating the chamber switch 44. This operation also induces a measured amount of fuel to be released into the combustion chamber 18 from a fuel canister 50 (shown in fragment).

In a mode of operation known as sequential operation, upon a pulling of the trigger 26, the spark plug 46 is energized, igniting the fuel and air mixture in the combustion chamber 18 and sending the piston 22 and the driver blade 24 downward toward the waiting fastener for entry into the workpiece. As the piston 22 travels down the cylinder 20, it pushes a rush of air which is exhausted through at least one petal, reed or check valve 52 and at least one vent hole 53 located beyond the piston displacement (FIG. 2). At the bottom of the piston stroke or the maximum piston travel distance, the piston 22 impacts a resilient bumper 54 as is known in the art. With the piston 22 beyond the exhaust check valve 52, high pressure gasses vent from the cylinder 20. Due to internal pressure differentials in the cylinder 20, the piston 22 is drawn back to the pre-firing position shown in FIG. 3.

As described above, one of the issues confronting designers of combustion-powered tools of this type is the need for a rapid return of the piston 22 to pre-firing position prior to the next cycle. This need is especially critical if the tool is to be fired in a repetitive cycle mode, where an ignition occurs each time the workpiece contact element 32 is retracted, and during which time the trigger 26 is continually held in the pulled or squeezed position. During repetitive cycle operation, ignition of the tool is triggered upon the chamber switch 44 being closed as the valve sleeve 36 reaches its uppermost position (FIG. 3). Such repetitive cycle operation often leads to elevated tool operating temperatures, which extend the piston return time.

To manage those cases where extended tool cycling and/or elevated ambient temperatures induce high tool temperature, at least one temperature sensing device 60 such as a thermistor (shown hidden in FIG. 1) is preferably located at a lower end of the cylinder 20 and is preferably disposed to be in or in operational relationship to, a forced-convection flow stream F of the tool 10 (FIG. 2). Other types of temperature sensing devices are contemplated. Also, other locations on the tool 10 are contemplated depending on the application. The temperature sensing device 60 is connected to a control program 66 associated with a central processing unit (CPU) 67 (shown hidden in FIG. 1) and is configured to extend 'on time' of the at least one cooling fan 48 until the temperature is lowered to the preferred "normal" operating range. Alternately, the program 66 is configured to hold the fan 48 on for a fixed time, for example 90 seconds, which is long enough to assure that the combustion chamber temperature has returned to the "normal" operating range. In the preferred embodiment, the program 66 and the CPU 67 are located in a handle portion 68 of the tool 10.

The temperature threshold is selected based upon the proximity of the temperature sensing device 60 to the components of the power source 14, the internal forced convection flow stream, and desired cooling effects to avoid nuisance fan operation. Excessive fan run time unnecessarily draws contaminants into the tool 10 and depletes battery power. Other drawbacks of excessive fan run time include premature failure of fan components and less fan-induced operational noise of the tool 10. For demanding high cycle rate applications and/or when elevated ambient temperatures present overheating issues, temperature controlled forced convection will yield more reliable combustion-powered nail performance and will also reduce thermal stress on the tool.

Figure 4A:
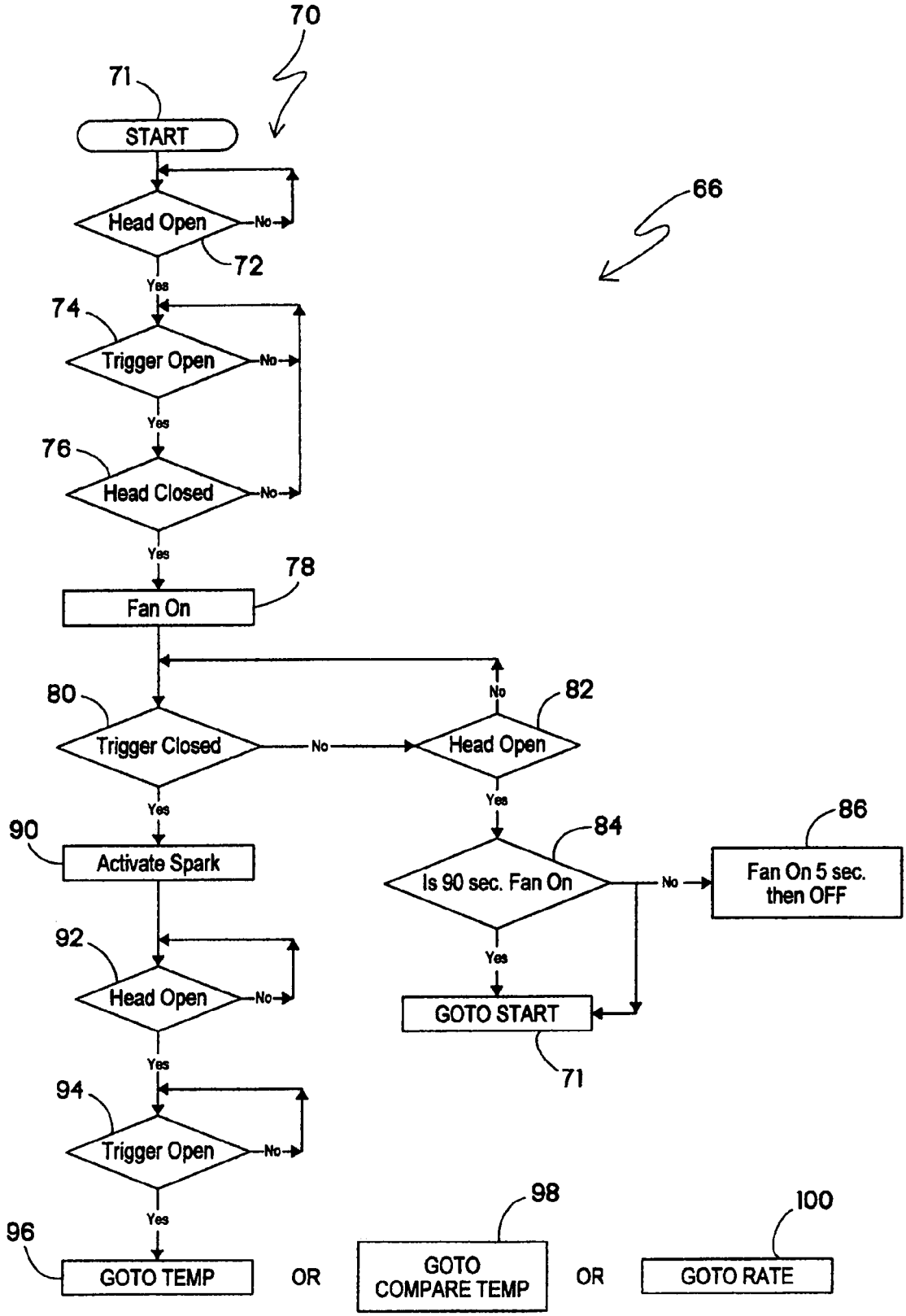
FIGS. 4A-C are an operational flowchart illustrating a control program wherein the tool temperature is monitored for fan energization when needed.

Referring now to FIG. 4A and considering a sequential firing mode, although the present program can be applied to a repetitive firing mode as well, a portion of the control program 66 associated with monitoring tool temperature is generally designated 70. Beginning at the START prompt 71, the program 70 determines at 72 if the chamber switch 44 (designated HEAD) is open or not. A closed HEAD signifies that the combustion chamber 18 is closed and ready for combustion. If the HEAD is closed, the program cycles. If the HEAD is open, the program 70 checks whether the trigger 26 is open at 74. If the trigger 26 is closed with the HEAD open, the program cycles. At step 76, once the HEAD is closed, the fan 48 is turned on at step 78, which circulates fuel and air mixed in the combustion chamber 18.

Next, the program 70 checks whether to activate the ignition process by determining whether the trigger 26 is closed at 80 or the HEAD is open at 82. If the trigger 26 has not been closed, and the HEAD 44 reopened, as if the operator was interrupted in using the tool 10 or decided to put it down unused, the program 70 checks at 84 whether the 90 second fan signal is on. If not, that indicates that the tool has not been used, and the fan 48 is turned on at 86 for 5 seconds, and then is turned off. If the 90 second fan signal has been turned on, the program 70 returns to START at 71, and the extended cooling cycle continues.

Returning to the trigger closed 80-HEAD open 82 loop, once the trigger 26 is closed, indicating a combustion is desired, the program 70 activates a spark at 90, which may also be performed in conjunction with the control circuit 66. After ignition, the program 70 determines whether the HEAD 44 is open at 92, and if not, the program cycles. If the HEAD 44 is open, the program 70 checks to see if the trigger 26 is open at 94. If not, the program 70 cycles until the trigger does open, at which time the program goes to TEMP at 96, or COMPARE TEMP at 98, or to RATE at 100, depending on which of the present embodiments is employed. The TEMP 96 subroutine uses one temperature sensor 60 to monitor tool temperature and turn on the fan 48 into extended operation, also known as "overdrive" when tool temperature exceeds a preset value. The COMPARE TEMP 98 subroutine uses a calculated value based on readings of two temperature sensors to activate the fan 48 into overdrive, and the RATE 100 subroutine monitors the firing rate of the tool 10 to activate fan overdrive.

Figure 4B:
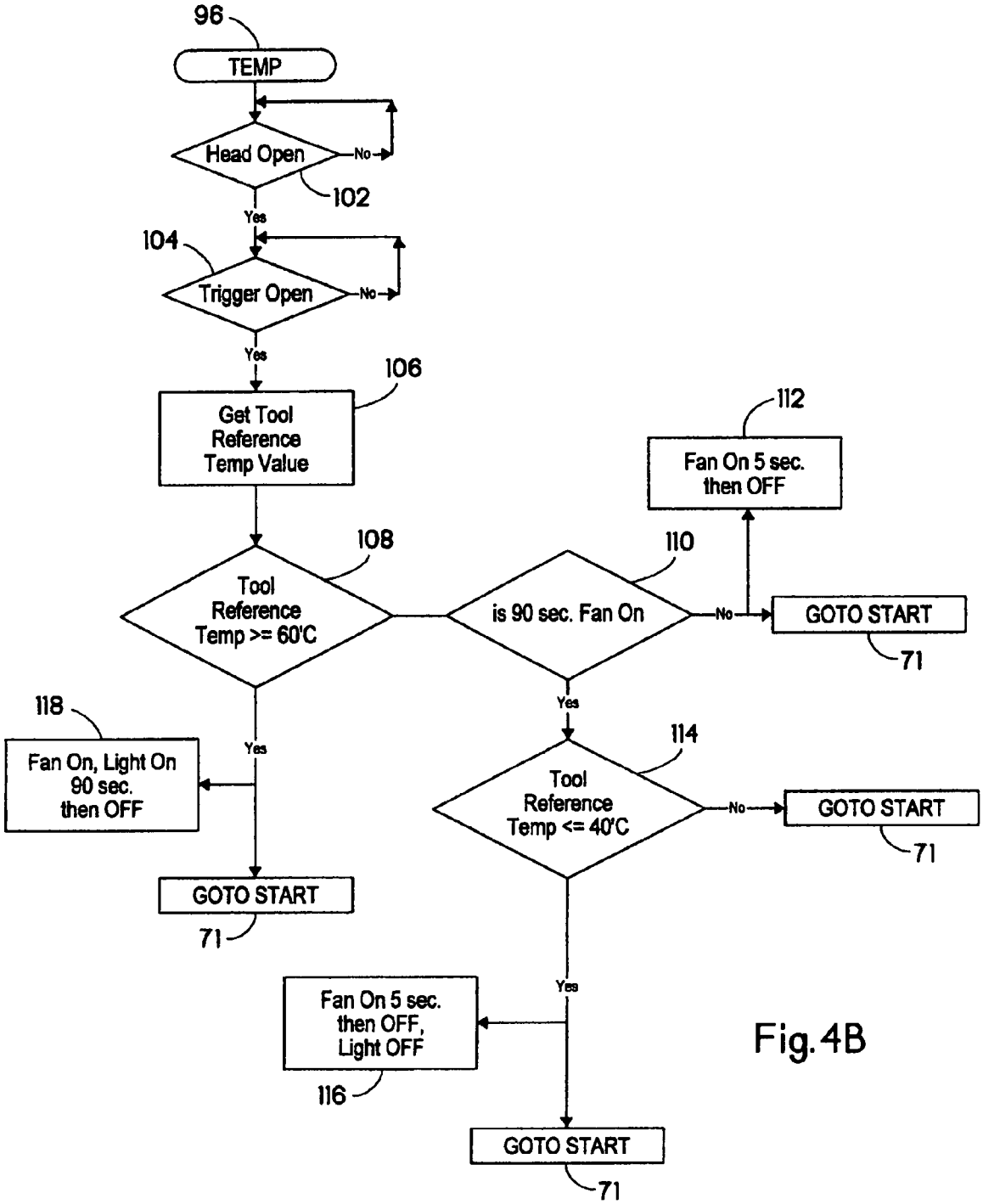

Referring now to FIG. 4B, the TEMP subroutine 96 first determines whether the HEAD 44 is open at 102. Once the HEAD 44 is determined to be opened, the trigger 26 is checked at 104. If the trigger 26 is closed, indicating that the operator is actively using the tool, the program 70 cycles until the trigger is open. At that time, at step 106, the program 70 monitors the temperature from the temperature sensor 60. At step 108, the program 70 determines whether the sensed temperature is greater than 60° C. If the temperature is not greater than 60° C., at 108, the program 70 determines if the 90 second fan timer has been activated at 110, which would also indicate that the fan 48 had been energized for that period. If not, indicating the tool 10 has not been extensively used or use has been discontinued, the fan 48 is turned on for 5 seconds at 112 and then is turned off, following which the program 70 reverts to the START routine 71.

If the temperature is greater than 60° C. at 108 and the 90 second fan timer, as well as the fan 48, has been turned on at 110, then the temperature sensor 60 is checked at 114 to determine if the monitored temperature is less than or equal to 40° C. If not, indicating the tool is still at operational temperature, the program 70 begins the START routine at 71. If the sensed tool temperature has been reduced to less than or equal to 40° C. after operation of the 90 second fan timer and the fan 48, even if the 90 seconds has not expired, the 90 second timer reverts to a 5 second fan timer, which is turned on at 116. After 5 seconds, the fan 48, and an optional indicator, such as a light and/or audible alarm 115 (FIG. 1) which was turned on in conjunction with the energization of the 90 second fan timer (discussed below at 118) is turned off. Next, the program 70 goes to START at 71.

If the monitored tool temperature is greater than or equal to 60° C. at 108, then the fan 48, the fan timer, as well as the optional indicator 115 is turned on for 90 seconds at 118, then both are turned off, following which the program 70 goes to START at 71. It is preferred that the fan running for 90 seconds is sufficient to cool the tool 10 during operation and prevent overheating. However, it will be understood that the temperature levels and fan run times discussed herein may be modified to suit the particular application.

Figure 4C:
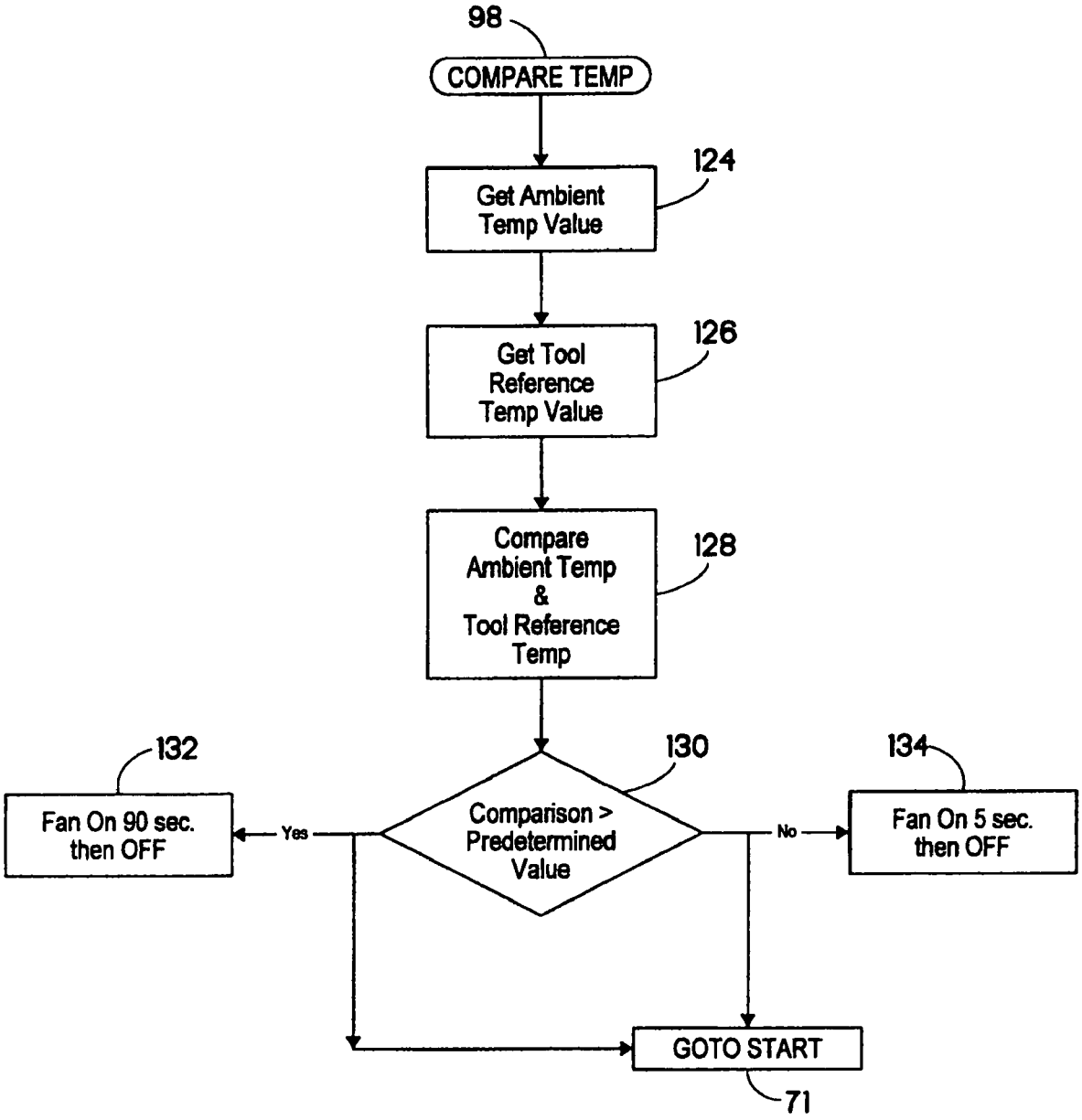

Referring now to FIG. 4C, the COMPARE TEMP subroutine 98 is provided. In this embodiment, the tool 10 is provided with a first temperature sensor 60 near the power source 14, such as the cylinder 20 or the combustion chamber 18. A second temperature sensor 120 (shown hidden in FIG. 1) is also located on the tool 10, but further from the power source 14 such that it is not significantly affected by the power source 14. One potential location is on the tool housing 12 in the handle portion 68, however other locations are contemplated.

Initially, at step 124, the program 70 determines the ambient, or close to ambient reference temperature value from reading the second temperature sensor 120. Next, at step 126, the program 70 determines the tool reference temperature from the first temperature sensor 60 located closer to the power source 14. At step 128, the readings from the sensors 120 and 60 are compared, obtaining a $\Delta T$ value. At step 130, the resulting difference $\Delta T$ is compared against a predetermined value, such as a conventional "look-up" table developed to suit the application. If the resulting difference is greater than the predetermined value, then at step 132 the fan 48 is turned on for 90 seconds, then is turned off. If the resulting difference is less than the predetermined value, then at step 134 the fan 48 is turned on for 5 seconds, then off. It is also contemplated that the subroutine 98 is configurable so that the greater the difference $\Delta T$, the longer the fan run time. At the conclusion of either activation of the fan, the program returns to START at 71. It is also contemplated that the $\Delta T$ can be compared to the ambient reference temperature to determine fan run time.

Figure 4D:
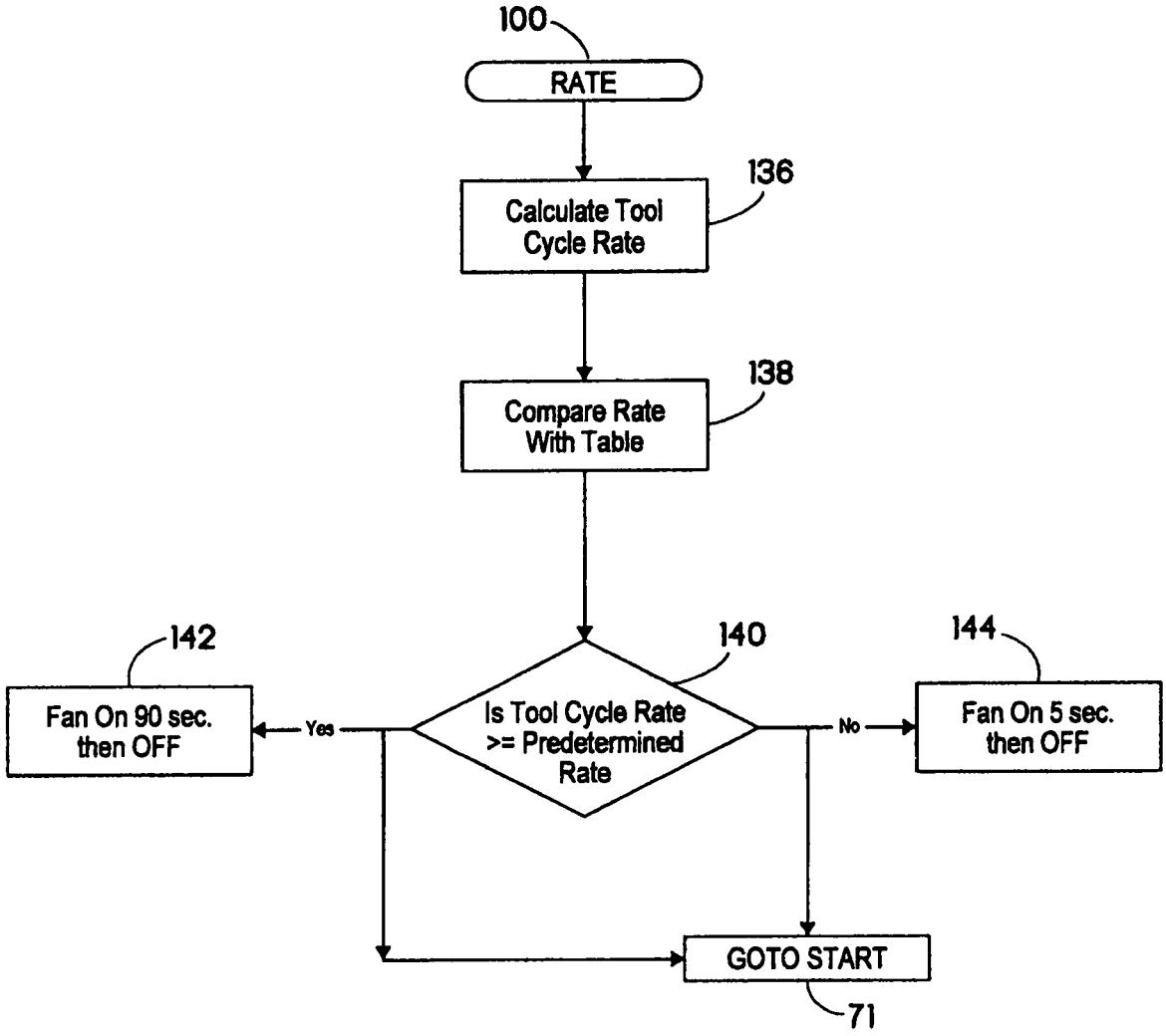
FIG. 4D is an operational flowchart illustrating a control program subroutine wherein tool firing rate is monitored for fan energization.

Referring now to FIG. 4D, the RATE subroutine 100 is described. A tool cycle rate, or the number of firings per minute, or the number of combustions or ignitions of the spark plug 46 over time, is determined by the program 70 at step 136, and then that value is compared against a predetermined rate at step 138 as in a "look-up" table. This data is preferably monitored by the CPU 67. Depending on the application, a threshold firing rate is established and added to the program 70 which is considered sufficient to cause an excessive tool temperature, for example 60° C. The program 70 then checks at step 140 to determine whether the firing rate exceeds the predetermined rate, and if so, the tool 10 is likely overheating or has a raised operating temperature. As such, at step 142, the fan is turned on for 90 seconds, then is turned off. If the tool 10 is so equipped, the indicator 115 is temporarily energized, as described above in relation to FIG. 4B. If the calculated firing rate is less than the predetermined rate, indicating that tool temperature is acceptable, the fan 48 is turned on for 5 seconds at step 144, then is turned off, again optionally with periodic energization of the indicator 115. Upon the execution of either of steps 142 or 144, the program 70 returns to start at 71.

Note that it is contemplated that the program 70 may be configured so that GO TO TEMP 96, GO TO COMPARE TEMP 98 and GO TO RATE 100 may be used in combination with each other, and are not required to be exclusively used as a fan control.

While a particular embodiment of the present temperature monitoring for fan control for combustion-powered fastener-driving tool has been described herein, it will be appreciated by those skilled in the art that changes and modifications may be made thereto without departing from the invention in its broader aspects and as set forth in the following claims.

The invention claimed is:

1. A combustion-powered fastener-driving tool, comprising:

a combustion-powered power source;

at least one fan associated with said power source during operation;

a control system operationally associated with said power source and connected to said at least one fan for adjusting a length of time for turning on said at least one fan as a function of the number of tool operations by said power source; and wherein said function is directly determined by said control system counting the number of tool operations per unit time.

2. The tool of claim 1 further including at least one temperature sensing device, wherein said temperature sensing device is used by said control system for determining the length of time said at least one fan is turned on.

3. The tool of claim 1 wherein said control system counts said number of tool operations per unit time to determine an operational rate, and operates said at least one fan upon said operations rate exceeding a predetermined amount, said control system including a first fan operational mode and a second extended operating fan operational mode, said control system being programmed so that if the monitored rate exceeds a predetermined rate, said control system turns on said fan at said second operational mode.

* * * * *